US005445465A

United States Patent [19]

Cardia

[11] Patent Number: 5,445,465

[45] Date of Patent: Aug. 29, 1995

[54] DISPENSING CONTAINER

[76] Inventor: Ennio Cardia, No. 18, Via Durazzo, 00195 Roma, Italy

[21] Appl. No.: 340,437

[22] Filed: Nov. 14, 1994

Related U.S. Application Data

[63] Continuation of Ser. No. 917,669, Jul. 21, 1992, abandoned, which is a continuation of Ser. No. 457,538, Mar. 9, 1990, abandoned.

[30] Foreign Application Priority Data

Mar. 10, 1989 [IT] Italy ..... 47736A/89

[51] Int. Cl.[6] ..... A45D 40/06; A45D 40/04

[52] U.S. Cl. ..... 401/175; 401/68; 401/75

[58] Field of Search ..... 401/68, 75, 175

[56] References Cited

U.S. PATENT DOCUMENTS

| | | | |
|---|---|---|---|
| 1,783,754 | 12/1930 | Stepelton | 401/175 |
| 2,485,467 | 10/1949 | Weisbaum | 222/390 |
| 2,612,991 | 10/1952 | Braselton | 401/75 |
| 2,816,309 | 12/1957 | Worth et al. | 401/175 |
| 2,917,765 | 12/1959 | Jakubowski | 401/175 |
| 3,616,970 | 11/1971 | Baumann et al. | 222/390 |
| 4,139,127 | 2/1979 | Gentile | 222/390 |
| 4,232,977 | 11/1980 | Chutter | 401/68 |
| 4,363,560 | 12/1982 | Gentile | 401/68 |
| 4,521,127 | 6/1985 | Tomburo et al. | 401/75 |
| 4,579,134 | 4/1986 | Moore | 401/192 X |
| 4,702,399 | 10/1987 | Davis | 401/75 |
| 4,850,516 | 7/1989 | Seager | 222/390 |
| 4,984,718 | 1/1991 | Cardia | 401/175 X |
| 5,000,600 | 3/1991 | Cardia et al. | 401/175 X |

FOREIGN PATENT DOCUMENTS

| | | | |
|---|---|---|---|
| 617329 | 2/1927 | France | 401/175 |
| 667224 | 10/1929 | France | 401/175 |
| 1011277 | 4/1952 | France | 401/175 |
| 1044333 | 11/1953 | France | 401/75 |
| 1283961 | 1/1962 | France | 401/175 |
| 3118893 | 11/1982 | Germany | 401/68 |
| 337521 | 3/1936 | Italy | 401/175 |

*Primary Examiner*—Steven A. Bratlie
*Attorney, Agent, or Firm*—Browdy and Neimark

[57] ABSTRACT

A dispensing container for a viscous fluid or a stick-shaped solidified product comprising a coupling between the driving member and a tight-seal inner body, the container having go grooves and no guiding ribs, and wherein normal axial guide ribs are replaced by a perimetrically continuous elastic friction means that prevent the propelling member or piston from rotating with respect to the inner body so as to slide in an axial direction.

3 Claims, 4 Drawing Sheets

FIG. 5
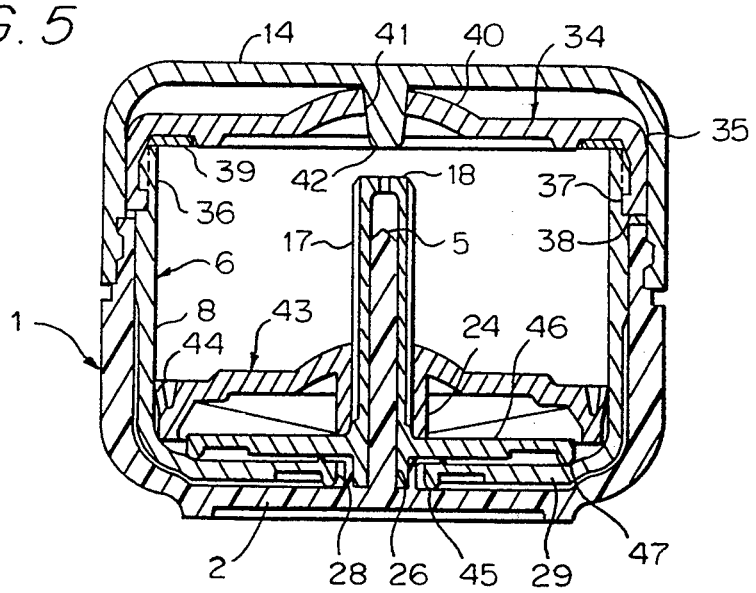
FIG. 6
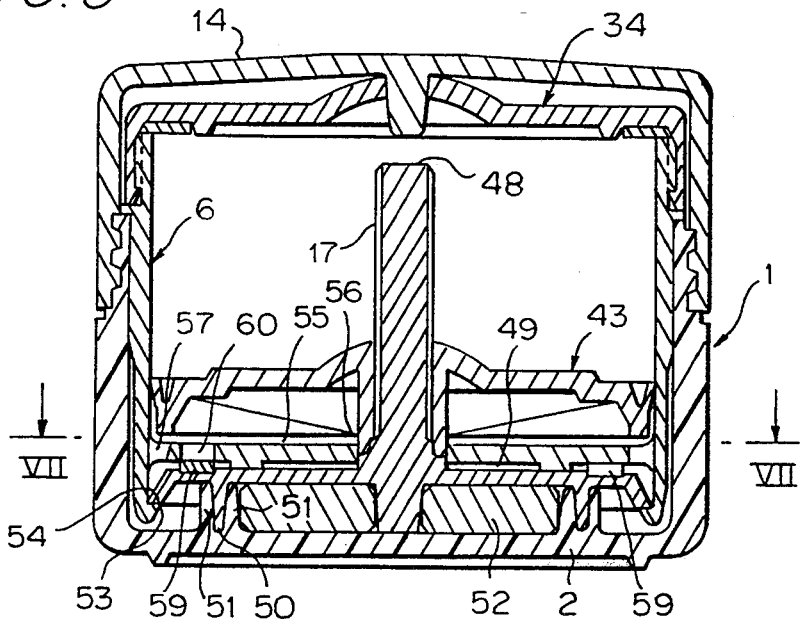
FIG. 7
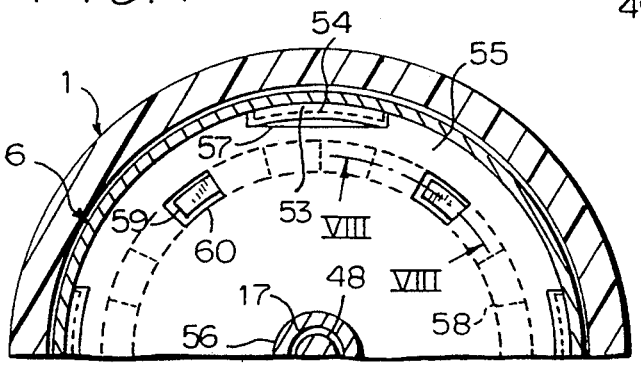
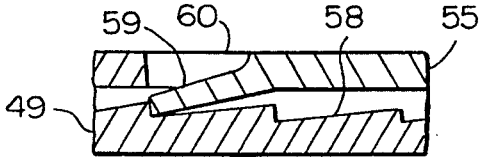
FIG. 8

DISPENSING CONTAINER

This application is a continuation of application Ser. No. 07/917,669, filed Jul. 21, 1992, which is a continuation of 07/457,538, filed Mar. 9, 1990 both abandoned.

BACKGROUND OF THE INVENTION

1. Field of the Invention

This invention relates to a container which serves the purpose of dispensing products, generally of cosmetic or pharmaceutical type in the form of a solidified stick-shaped fluid, such as deodorants or lipsticks, or of a viscous fluid, such as a creme, a gel or the like.

The container is of the type comprising a driving member having a central threaded opening, such as a stick-holder or a pressing piston endowed with a rotational and translation motion controlled by an axial threaded rod, following a mutual rotation of two bodies which are external to the container and reciprocally rotatable.

2. The Prior Art.

Containers of such general kind are already well known in the prior art, some representative examples of the same being lipstick containers and stick-shaped deodorant containers which are available on the market, as well as containers disclosed in my preceding Italian patent application no. 47711A88 which also comprises creme dispensing devices.

Dispensing containers for a viscous fluid or a stick-shaped solidified product, wherein said stick is supported by a driving member endowed with a rotatory-translation motion according to the prior art are disclosed in my preceding patent application mentioned above, and: an outer tubular body having a circular section inner surface, a bottom end closed by a closure bottom and a threaded rod integral with said closure bottom and which projects along the axis of the external body towards its top portion; an inner tubular body which is coaxial with said external body and has an outer surface in sliding contact with the inner surface of the external body, and an opening corresponding to its top end, said internal and external bodies being constrained by engagement means which hinder reciprocal motion in the axial direction, so that a rotational relative motion can be performed about their common longitudinal axis, and said internal body protruding above the top part of the external body; said driving member being movable according to a rotational and translation motion following the reciprocal rotation of the external and the internal bodies, as it is engaged through a threaded engagement on a central opening with a threading in said rod, and as it is slidable with its external wall along said inner surface of the internal body.

The rod which is integral with the bottom of the external body is considered a drawback because it is hard to mold, as said rod is molded within a glass-shaped tubular body and is provided with a number of undercuts due to the reduced pitch threading.

In my patent Italian application no. 47711A88 mentioned above now U.S. Pat. No. 4,984,718, an example has been illustrated in FIG. 10 of a rod which is provided at the basis of the plate, and is molded separately from the outer body bottom and is made successively integral through snap axial engagement of openings in the plate itself which engages with respective small projecting portions starting from the bottom surface of the outer body.

The shining material which is commonly employed for aesthetic purposes to make the outer body is not very elastic so that it is not very suitable for being molded so as to bear inner undercuts in the inner bottom of the external body.

It is to be taken into account that an easy molding operation for such component bodies of the container is of fundamental importance both from the practical and the commercial viewpoint.

Other conventional containers which are available on the market for stick-shaped products include a holder which is threadedly engaged with a rod which is integral with the controlling body and is slidable along the inside of the internal body, which rod is normally provided with one or more guiding grooves in its outer surface, which engage with respective guiding ribs on the inner surface of the internal body, so that said rod is constrained to move in the axial direction in order to avoid the rotation of the driving body that drives the rod integrally into rotation.

The presence of ribs is often prejudicial to the outer aspect of the stick-shaped product, and such ribs cannot be employed for containing a fluid material and least of all for preserving volatile or degradable materials contained in the product.

SUMMARY OF THE INVENTION

The container of the present invention comprises a coupling between the driving member and the tight-seal inner body, with no grooves and no respective guiding ribs, and the axial guide ribs are replaced by a perimetrical continuous elastic friction means capable of preventing the propelling member from rotating with respect to the inner body so as to slide in the axial sense.

The following further advantages obtained according to the present invention add to the preceding ones:

the threaded rod is molded as a separate part from the basis outer body so that it can be easily molded and coupled in an integral way to the bottom of the base body by means of a simple bonding operation, for instance by supersonic waves, or by forced compression that generates gripping or through hooking between the relative facing or opposite surfaces of the bottom surface of the outer body or of the rod, or surfaces which are integral with the rod itself;

some means which make the rotational motion unidirectional can be provided between the outer body and the inner body, so that the driving member can slide axially upwards, as the downward motion is hindered; this solution is particularly useful for fluid products which are degradable when in contact with air, owing to the requirement that the product can go out in order to prevent the driving member from coming downward, and giving rise to air leakage into the container holding the product due to suction;

the wall of the inner body can be of variable thickness because the outer wall, which is slidable and coupled with the inner wall of the outer body, is of circular section and the inner wall is not of circular section, being for instance of elliptical, oval, heart-shaped or of a polygonal section or the like, on which the outer wall of the driving member slides axially and adheres with friction, so adapting itself to the shape of the inner wall of the internal body;

the outer body and the inner body can be constructed with a transparent material so as to make it possible to see the driving member and the product in transparence.

Other characteristics and advantages of the present invention will be more evident from the following disclosure of some preferred embodiments of the same, with reference to the enclosed drawings, wherein:

BRIEF DESCRIPTION OF THE DRAWINGS

FIG. 5 shows a container according to the present invention, provided with an embodiment with closed top end which bears a central opening for dispensing viscous, creme-like fluid products;

FIG. 6 is a modification of FIG. 5 showing solutions to the problem concerning the integral coupling between the plate which is integral with the rod, and the bottom of the outer body, and means for giving rise to the unidirectional rotational-translation motion;

FIG. 7 is a cross-sectional view along the line VII—VII of FIG. 6;

FIG. 8 is a cross-sectional view along the line VIII—VIII of FIG. 7;

DETAILED DESCRIPTION OF THE INVENTION

Figure 1A:
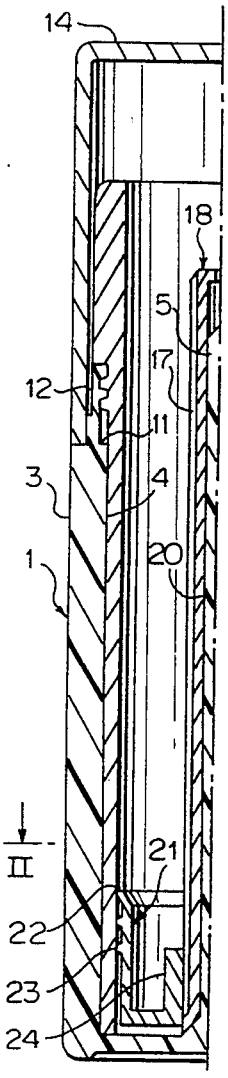
FIG. 1 shows a longitudinal cross-sectional view of a dispensing container according to the present invention, in particular for stick-shaped products, the stick being provided with a hollow threaded rod.

With reference now to FIGS. 1 and 2, which is the cross-sectional view II—II of FIG. 1, the dispensing container of the present invention is shown in a kind of embodiment which is suitable for containing solidified fluid products, i.e., products which are commonly called "stick-shaped"; as for instance deodorants, lipsticks and the like. More particularly, FIG. 1 is suitable as a container for a lip ointment.

The following members of the container according to the present invention are shared by all embodiments illustrated herein, both for solidified and for creme-like products.

An outer tubular body 1, closed at the bottom end by a bottom 2, and open at the point corresponding to the top end, has an outer surface 3 and an inner surface 4 whose transverse section with respect to the longitudinal axis of the outer body 1 is of circular shape.

A rod 5 is present which is integral with the bottom 2 and projects toward the top end of the outer body 1.

An inner tubular body 6 is coaxial with the outer body 1 and has an outer surface 7 whose transverse cross-section is of circular shape, which surface is slidable in contact with the inner surface 4 of the outer body 1, and it also has an inner surface 8 and protrudes above the outer body 1 with a projecting portion 9.

The outer body 1 and the inner body 6 can rotate with respect to one another sliding along the respective surfaces, i.e., the inner surface 4 and the outer surface 7, about the common longitudinal axis. The two bodies 1 and 6 however are constrained with respect to a motion in the axial sense.

The constraint that hinders the mutual axial motion can be realized according to different ways.

In FIG. 1, the constraint is realized at the point corresponding to the top end of the outer body 1. Said outer body 1 has at the top a wall 10 of reduced thickness, the reduction in wall thickness being realized both at 11, starting from the inner surface 4, and at 12, starting from the outer surface 3 of the outer body 1. Thus the wall 10 of reduced thickness has a step 13 on its outer wall, on which step a cover 14 can be supported.

The wall 11 of the outer body 1 has one or more annular ribs 15 projecting towards the inside and forming in the space between them a number of grooves in which the similar annular ribs 16 of the inner body 6 engage, said ribs projecting towards the outside. This engagement, which in the assembling operation of the container occurs as a snap engagement locks the two bodies 1 and 6 as regards their axial shift, though it allows such bodies to rotate relatively to one another.

One of the features of the present invention consists in that a threading 17, obtained in an axially hollow rod 18 as shown in FIG. 1, is made integral as if it were a whole with the bottom of the outer body 1.

Such coupling is by a bonding operation, for instance by means of supersonic waves, or by means of a forced compression between the respective opposite surfaces, i.e. the inner surface 19 of the hollow 18, and the outer surface 20 of the rod 5, to realize gripping.

It is preferable that both surfaces, the inner surface 19 of the hollow rod, and the outer surface 20 of the rod 5, be of non-circular cross-section in order to prevent them from possibly rotating with respect to one another.

A driving member 21 which can both rotate and slide is shown in the top end position (21' in FIG. 1*b*) and in the end withdrawn bottom position (21 in FIG. 1*a*).

The driving member, in the case of the embodiment shown in FIG. 1, is made up of a holder that serves the purpose of supporting the product and of pushing the same upwards for employment.

In the case of stick-shaped solidified products, the driving member is in the shape of a holder, whereas in the case of creme-like products, it is in the shape of a pressing piston.

In the following, the terms "holder" and "piston" will be employed synonymously with "driving member", as the case may be.

In the embodiment illustrated in FIG. 1, the holder 21 is coupled with a threading 17 of the rod 18 by means of a thread-like coupling of the threaded inner tubular wall 24.

The inner surface 8 of the inner body 6 has no guiding ribs, and the shift of the holder 21 in the axial sense is obtained through a conformation of the holder itself that generates a frictional resisting force between said holder 21 and said inner surface 8 of the inner body 6.

Such frictional resisting force is obtained by means of a flared portion 22 on the upper edge of the holder, which portion scrapes the inner surface 8, and in addition by means of the ribs 23 projecting towards the outside of the holder which cooperate in the scraping action and in keeping the alignment. Thus the stick-shaped product coming out of the inner body 6 is free from the unaesthetic marks of the guiding ribs.

A cover 14 is in contact with the outer body 1 on the step 13 and on the outer wall 12 of the reduced thickness wall 10, whereas it is not in contact with the projecting portion 9 of the inner body 6.

When the cover 14 is applied, the line of the step 13 will only be visible from the outside, and this will allow the outer surface 3 and the bottom 2 of the outer body 1 as well as the cover 14 to be shaped according to any conformation of the outer transverse cross-section.

In order to obtain the rotational-translational motion of the holder 21, the inner body 6 will be rotated with respect to the outer body 1, or vice-versa.

The rotation occurs along the contact between the inner surface 4 of the body 1 and the outer surface 7 of the body 6. This allows the inner surface 8 of the inner body 6 to be of any conformation of transverse cross-section, so that the cross-section of the stick can be realized even in shapes different from the circular shape, such as the elliptical, the oval, the heart-like or the polygonal shape, and other similar shapes.

The structure illustrated has the advantage that if the inner body 6 is made up of a transparent material, it is possible to see the upper portion of the product in transparence, if the cap also is transparent, without removing the cover; if the outer body 1 also is transparent, it is also possible to see in transparence both the driving member and the whole product.

In general, the outer body 1 and the inner body 6 can be made up of a number of pieces, when this is necessary because of molding reasons or of compatibility reasons between the various kinds of plastic materials and the product to be contained.

Moreover, the constraint that hinders the axial motion of the inner and of the outer body can be put both at the point corresponding to the top, as shown in FIG. 1, and at the point corresponding to the bottom end, as be illustrated in other embodiments.

In the various embodiments illustrated in the following, equal reference numerals of FIG. 1 are employed as much as possible to point out similar parts.

Figure 1B:
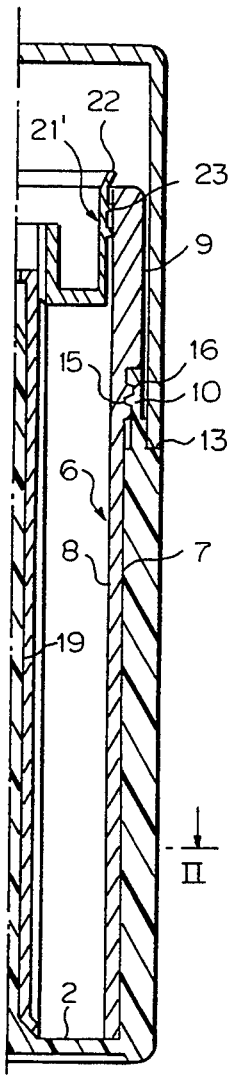
Figure 2A:
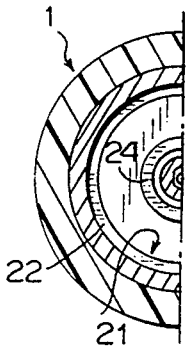
FIG. 2 is a cross-sectional view along the line II—II of FIG. 1.
Figure 2B:
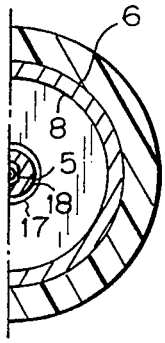

The container in the cross-sectional view along the line II—II of FIG. 1 is shown in FIG. 2*a* with its holder 21 in the withdrawn position and in FIG. 2*b* without holder, said holder being shown in FIG. 1*b* in the position of top end above the cross-sectional line.

The coupling FIG. 2*a* of the outer wall of the holder, which is provided with a flared upper edge 22 which presses elastically the inner wall 8 of the inner body 6, and is characterized by a uniform shape with no grooves and no respective ribs and is able to contribute an optimal fluid-tight seal in addition to efficient friction.

Figure 3:
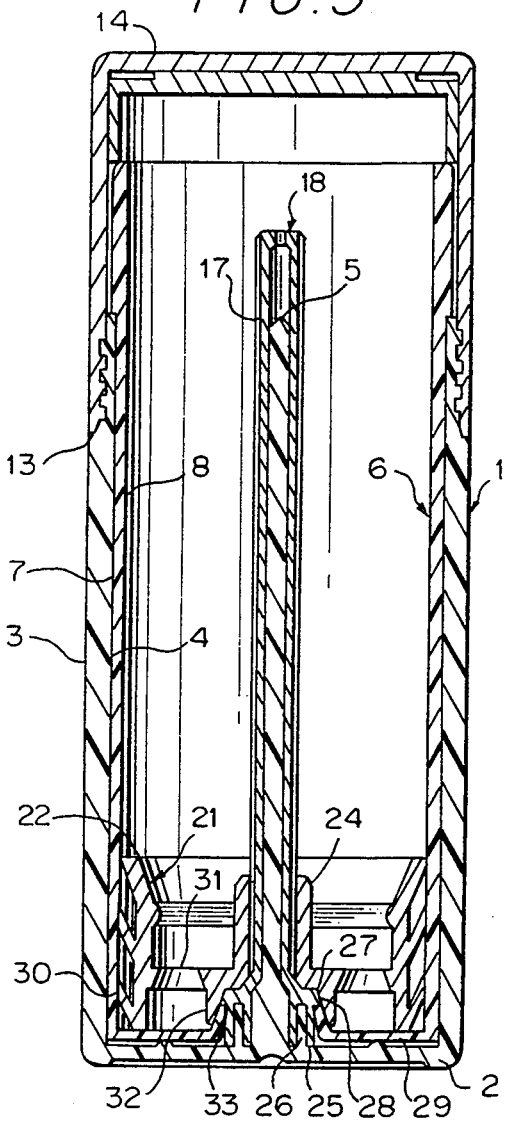
FIG. 3 is a modification of FIG. 2, suitable for deodorant products.

FIG. 3 shows an embodiment which is suitable for a stick-shaped deodorant product, in which embodiment the fluid-tight seal is improved.

The axial engagement between the inner body 6 and the two bodies which are made integral so as to be considered as a whole portion, i.e., the outer body 1 and the threaded rod 18, is realized at the point corresponding to the bottom, instead of the top.

In this embodiment, the hollow rod 18 is connected near the base with a further tubular wall 25 projecting towards the bottom, which wall engages as a built-in part, or by pressure or by bonding with a respective tubular wall 26 projecting towards the top portion from the bottom of the outer body 1.

A radial and preferably annular tooth 27 is realized on said connection surface between the hollow rod 18 and said tubular wall 25, said tooth acting as an axial constraint as regards the central opening 28 realized on the bottom wall 29 of the inner body.

Said inner body 6 is assembled in the outer body 1 by causing the threaded rod 18, previously made integral with the rod 5 and with the wall 26 of the bottom 2 of the outer body 1, to slide into the central opening 28 till the projecting portion 27 snaps above the opening 28 so locking the inner body 6.

The holder 21 is provided with a wide flared portion 22 on the upper edge, as well as with further flanges 30 on its outer wall, below the upper edge, said flanges also being flared towards the inner surface 8 of the inner body 6, in replacement for the annular ribs 23, to ensure a better axial fluid-tight seal and better friction, which is able to obviate any possible defects in the flaring 22 occurring in the molding operations or owing to the introduction of the product in the molten state.

Moreover, said holder 21 is provided with openings 31 in its stick-supporting surface to allow the fluid product to be collected, when poured from the top of the body 6, into the underlying reservoir delimitated by the lower inner surface of the outer wall of said holder 21, by the bottom wall 29 of the inner body 6, and by a tubular wall 32. Said tubular wall 32, on the stick-supporting surface on the holder, projects towards the bottom and adheres with an elastic friction force, so as to allow a fluid-tight seal to be realized with the bottom wall 29 or with the tubular wall 33 which is integral with the same and projects towards the top portion.

The underlying reservoir that collects the product in the molten state is useful, in addition to the purpose of allowing a safer hooking with the solidified fluid product, also to previously form the end part of the stick by means of a closure cap that closes the top opening, after filling the product in the fluid state when such product is allowed to become solid, within the container in the upside down position.

Figure 4:
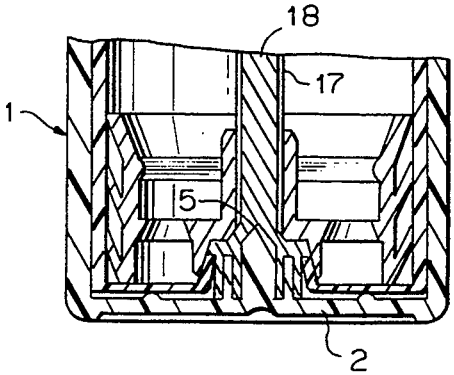
FIG. 4 is a modification of FIG. 3.

FIG. 4 shows a further modification for making the rod 18 integral with the bottom 2 of the outer body 1 as if they were a whole part.

According to such modification, the rod has been made hollow just to a reduced extent of the same, i.e. up to the level of the stick-supporting surface on the holder, so that the height of the respective rod 5 is reduced, and the engagement operation that makes the two bodies integral is considered sufficient.

FIGS. 5, 6, 9 and 11 show embodiments which are suitable for a viscous fluid product, like a creme, milk, gel and the like, which product is to be dispensed through an opening or a hole.

In said figures, the inner body 6 is closed by a closure plate 34 which is made integral, by means of the wall 35 projecting towards the bottom, with the upper portion 36 of the inner body 6 which is of reduced thickness with respect to the wall 9 of FIG. 1, that is projecting with respect to the upper end of the outer body 1.

A raised annular portion 37, projecting towards the inside and realized on the tubular wall 35 of the closure plate 34 snaps for engagement into a respective annular groove 38, which is obtained in the outer wall of said portion 36 of the inner body 6.

An annular gasket 39 is inserted between the closure plate 34 and the upper end of the inner body 6, to ensure a fluid-tight seal between the two bodies.

The closure wall 34 is provided at the centre with a projecting surface 40 which is provided with an opening or a hole 41 for dispensing the viscous fluid product.

Said raised surface 40 is useful for delimitating the contact area of fingers for drawing the product.

A central pivot 42 projecting towards the lower portion of the inner top wall of the cover 14 is inserted into the dispensing opening 41, when said cover is closed on the container, in order to further limit the possibility that the product comes in contact with air or with agents present in the environment outside the container.

The driving member is made up of a piston 43, which shows a lip-like conformation 44 whose function is that of realizing a peripheral fluid-tight seal against the inner surface 8 of the body 6, as well as of realizing the presence of a friction elastic member to exert the rotational-translation driving motion of the piston 43 by means of its inner threaded tubular wall 24 that engages with the threading 17 in the hollow rod 18.

Said axially hollow rod 18 is made integral, as if it were a whole part, through forced compression with the pivot 5 projecting from the bottom of the outer body.

The tubular wall 26, that projects from the bottom of the outer body 1 towards the top, cooperates with the pivot 5 in tightening and in pressing the lower end of the hollow rod 18 between the two bodies, with a gripping action.

The inner body 6 is provided at its lower end with a plate 29, which is provided with a central opening 28. Said opening is provided with an annular projecting part 45 that projects towards the bottom part 2, and is realized on an annular thickness reduction of the plate 29.

Said annular projecting portion 45 presses elastically, owing to the reduction in thickness of the plate 29, towards the central portion on the inner bottom wall 2, so as to cause both an elastic friction and a fluid tight seal to be realized.

A further plate 46 is realized above said plate 29, the plate 46 being integral with the lower portion of the hollow rod 18, so that it constrains axially said plate 29 between the inner bottom wall and said plate 46.

The plate 46 is provided near its peripheral portion with a reduction in thickness, an annular projecting part projecting downwards 47 being realized on the peripheral edge, said part pressing elastically the plate 29 owing to the reduction in thickness of the plate 46, so as to give rise both to a further elastic frictional force and to a fluid-tight seal.

FIG. 6 shows a modification of the structure of FIG. 5.

The threading 17 is realized on a solid rod 48, instead of being realized on a hollow rod like the preceding embodiments, which rod 48 is integral with a plate 49 at a position close to the base.

Said plate is made integral, as if it were a whole portion, with the bottom surface of the outer body 1 through bonding by supersonic waves or by pressure, of at least one tubular surface 50 projecting towards the bottom which is tightened till gripping is generated between at least two respective tubular surfaces 51 starting from the bottom surface 2 towards the top.

The engagement between said surfaces can be obviously inverted and the number of surfaces can be increased at will.

A supplementary body 52 can be inserted as a ballast between the bottom 2 and the plate 49, in order to make heavier a light container which is made up of a plastic material.

Said plate 49 is further provided with an annular projecting portion 53 and its peripheral end in order to give rise to an axial engagement with the projecting portions 54 facing the inside portion and placed at the lower end of the inner body 6.

The tubular wall of said inner body 6 is integral, within an area close to the lower end, with a plate 55 which is provided with a central opening 56, through which the rod 48 is inserted.

Said plate 55 is put above the plate 49 and is provided along its peripheral edge with sector openings 57 in the molding operation to give projecting portions 54 facing the inside part on the lower end of said body 6.

FIG. 7 shows through a cross-sectional view VII—VII the construction details of the plate 55.

In the assembling operation, first the plate 49 is made integral, as if it were a whole portion, with the bottom 2 of the outer body 1; next the inner body 6 is inserted into the outer body 1, causing the rod 48 to pass through the whole 56 and allowing the projecting portions 54 facing towards the inside parts to overcome the annular projecting portion 53 of the plate 49 to realize the axial constraint of the inner body 6 with respect to said plate integral with said rod 48 and integral with said outer body 1.

In order to cause the fluid product to go out only and not to come back into the container, it is necessary that the piston slides in one direction only towards the dispensing hole. As a consequence, the rotational motion between the inner body and the outer body, or the plate 49 which is integral with the same, must also be in one direction only.

In order to obtain such unidirectional rotational motion, a sawtooth series profile 58, shown in FIG. 8 which is a cross-sectional view VIII—VIII of FIG. 7, has been realized in the thickness of the upper wall of the plate 49, along a crown, at a position close to its peripheral part, on which profile the tabs 59 slide and exert an elastic pressure, said tabs being obtained through openings 60 realized along a respective crown-shaped surface on the plate 54.

Said tabs 59 can slide freely along said profile of sawtooth 58, whereas they oppose the motion in the contrary direction.

FIGS. 9 and 10 show modifications with respect to the positioning of the system that realizes the unidirectional rotational motion as well as to the hooking system between the plate 49 and the inner body.

Figure 9A:
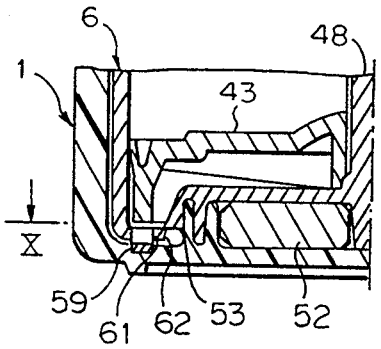
FIG. 9 is a modification of FIG. 6.
Figure 10A:
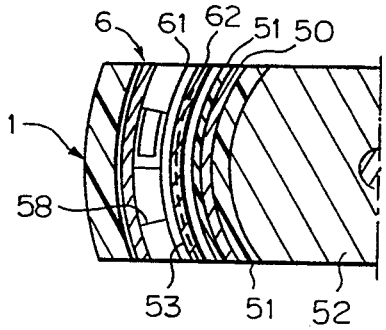
FIG. 10 is a cross-sectional view along the line X—X of FIG. 9.

In FIGS. 9*a* and 10*a* the lower end of the inner body 6 shows a transverse wall 61 in the shape of an L on the lower end of the inner body 6, instead of showing, like in FIG. 6, a U-shaped inner wall with which a plate 55 is integral.

The central hole 62 in said transverse wall 61 snaps for engagement into the annular projecting part 53 turned downwards of the plate 49 once said part has been passed, so as to realize an axial constraint between the inner body 6 and the plate 49 which is integral with the outer body 1.

Figure 9B:
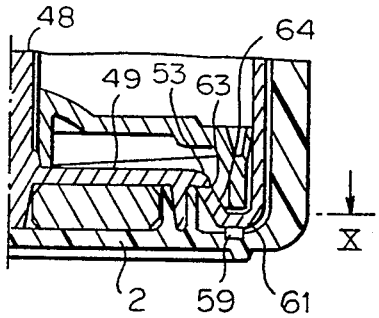
Figure 10B:
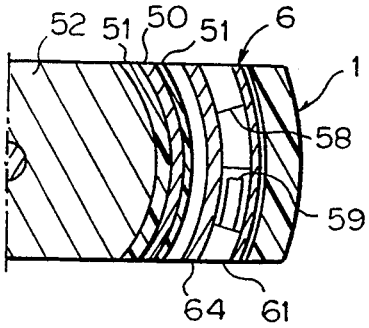

In FIGS. 9*b* and 10*b* projecting part 53 is reduced to the size of an annular tooth, with which a hole 63 is engage through snapping, said hole being obtained in a U-shaped wall turned towards the inside and integral with the wall 61 which is integral with the lower end of the inner body.

In this embodiment, the plate 55 has been eliminated and accordingly the lower end of the piston 43 can be pushed down to a lower level, till substantial interference with the wall 61, at a position closer to the bottom 2.

Moreover, the sawtooth series profile 58 has been realized along a crown on the inner wall of the bottom 2, whereas the elastic tabs 59 have been obtained in the transverse wall 61 of the lower end of the inner body 6.

Figure 11:
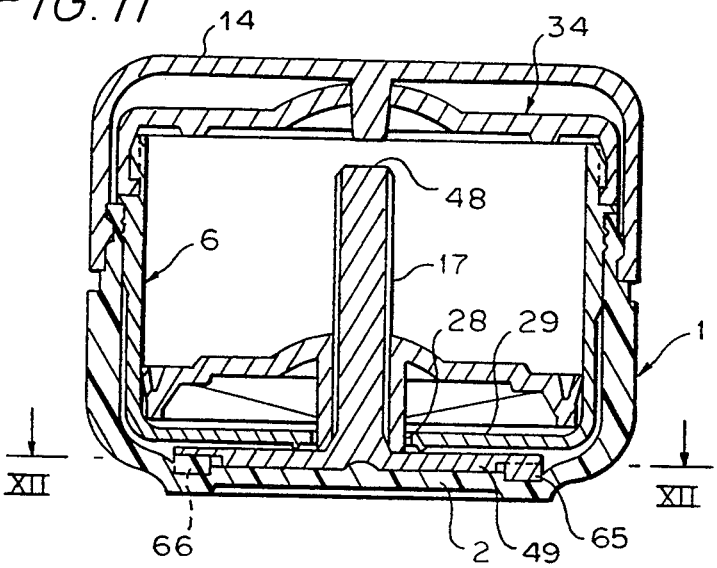
FIG. 11 is a modification of FIG. 6 with a change in the coupling between the plate which is integral with the rod and the bottom of the outer body.
Figure 12:
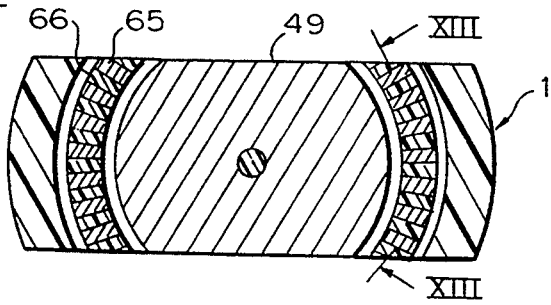
FIG. 12 is a cross-sectional view along the line XII—XII of FIG. 11.

FIGS. 11 and 12 show further modifications for making the plate 49 integral with the bottom part of the body 2, with a space reduced with respect to the embodiments shown in FIGS. 6 and 9.

As shown in said FIGS. 11 and 12, the plate 49 at the base of the threaded rod 48 is provided along a peripheral crown, with a continuous succession of radial tabs 65 which are comb-like arranged and project towards the bottom 2 and engage through forced compression with a corresponding continuous succession of radial tabs 66, which are also arranged in a comb-like way starting from the bottom 2 towards the top.

Said embodiment allows a stronger adherence between the corresponding projecting walls, and it accordingly allows their height to be reduced in order to occupy a reduced space for making the two bodies integral as if they were a hole portion.

Figure 13A:
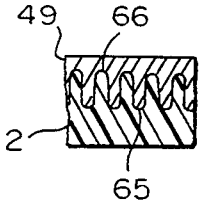
FIG. 13 is a cross-sectional view along the line XIII—XIII of FIG. 12.

FIG. 13*a* shows through a cross-sectional view XIII—XIII of FIG. 12 the succession of radial tabs 65 and 66.

The lower end of the inner body 6 is integral, as put into evidence in FIG. 5, with a bottom transverse wall 29 which is provided with a central hole 28, through which the rod 48 is passed. Said bottom wall 29 lies on top of the plate 49.

The axial constraint between the bodies 1 and 6 is realized as shown in FIG. 1, on the inner wall of the upper end of the outer body 1.

Figure 13B:
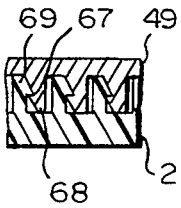

FIG. 13*b* shows through a cross-sectional view XIII—XIII of FIG. 12 a succession of tabs having on their ends, according to a modification of FIG. 13*a*, some respective projecting parts 67 which are turned towards one another so as to realize an integral constraint once they are engaged, the reference numeral 68 pointing out the succession of tabs borne by the plate 49, while the reference numeral 69 shows the respective succession of tabs borne by the bottom surface 2.

FIG. 14 is a modification of FIG. 11, which shows the inner body 6 having the lower end open and the upper end with a wall 70 which is reduced down to the size of the dispensing hole, said wall being realized as a single piece instead of being made up of two pieces, i.e., a body 6 and a body 34, which are made integral as realized in the preceding FIGS. 5, 6 and 11.

The plate 49 is provided with an annular tooth 53 on its peripheral part in addition to being provided with a succession of tabs 65 that engage under pressure with a corresponding succession of tabs 66 which are borne by the bottom 2, as shown in FIGS. 11 and 12, said annular tooth snapping for engagement with the projecting portion 54 facing towards the inside, and realized on the peripheral portion of the inside part, on the lower end of the inner body 6.

In the case of small diameters, a thickness reduction 71 can be realized on the lower end of the body 6 possibly through the realization of vertical cuts 72, in order to make the coupling of the projecting portion 54 with said tooth 53 more elastic.

Figure 14A:
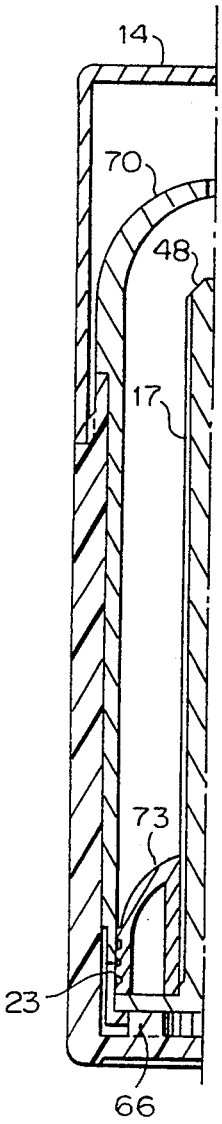
FIG. 14 is a modification of the container shown in FIG. 11 with the sizes of a sheath with hooking means having arrangements similar to those of the container shown in FIG. 9.
Figure 14B:
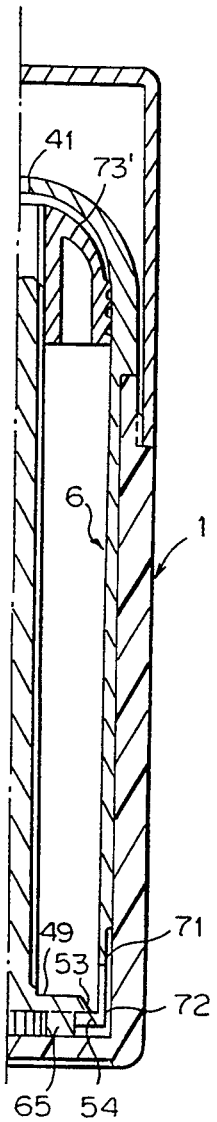

The driving member 73, which is shown in the withdrawn position in FIG. 14*a*, and is pointed out by the reference numeral 73' at the top end position in FIG. 14*b*, is in the form of a piston head conformed in a way complementary to the closure wall 70 having annular ribs 23 on its outer wall for friction and fluid-tight seal as shown in FIG. 1.

Figure 15A:
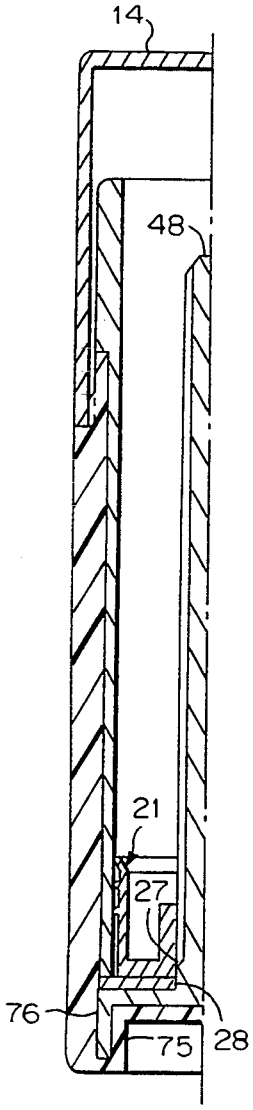
FIG. 15 is an embodiment of the invention particularly suitable for stick-shaped products.
Figure 15B:
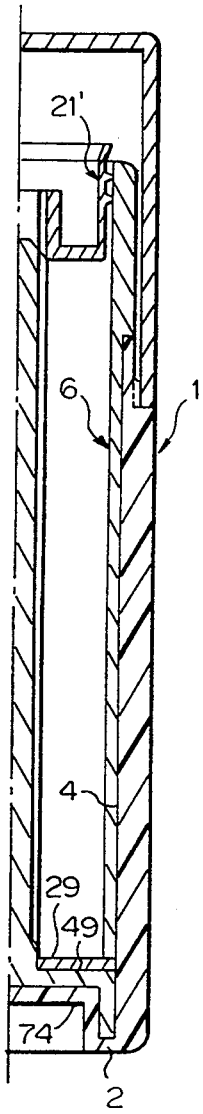

A further modification is shown in FIG. 15, which is useful for a stick-shaped product, for making the two bodies, i.e., the plate 49 and the bottom 2, integral.

A bottom wall 74 is placed above the bottom wall 2 by a certain height and is connected by means of a peripheral tubular wall 75.

The corresponding tubular wall 76, which is peripherally integral with the plate 49 placed at the base of the threaded rod 48, is inserted by pressure between the lower end of the inner wall 4 of the body 1 and said tubular wall 75.

An axial constraint between said bodies 6 and 1, which is integral with the rod 48, is realized through the central opening 28 of the bottom wall 29 of the body 6 which engages by snap with the tooth 27 arranged close to the base of the rod 48.

Figure 16A:
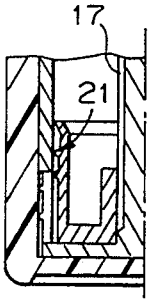
FIG. 16 shows a modification in the coupling between surfaces which are integral with the rod and the bottom of the outer body.
Figure 16B:
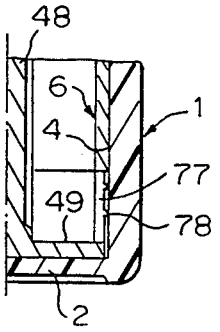

FIG. 16 shows a further modification for the purpose of making the two bodies 49 and 1 integral.

The wall 49 integral with the base portion of the threaded rod 48 is integral at its peripheral portion with a tubular wall 77 projecting upwards, which is possibly provided with vertical openings or slots, for obtaining the threading 17 at the base of the rod. Said vertical rod, provided on its outer wall with annular ribs 78, adheres by pressure to the inner wall 4 of the outer body 1.

Though this invention has been disclosed with considerable details according to various embodiments, it is to be understood that all such embodiments are comprised in a single inventive concept that characterises the fundamental structure of the dispensing container of the present invention.

I claims:

1. In a dispensing container for a dispensable product, of the kind comprising:

a) an outer tubular body with an inner surface of a circular section and having an open top end and a closed bottom end, from which a central element upwardly projects;

b) connection means rigidly connecting said closed bottom end with a threaded rod extending along a central axis of said outer body;

c) an inner tubular body arranged within said outer body, and having an inner smooth surface;

d) axial constraint means integrally formed on said threaded rod for precluding axial movement of said inner tubular body relative to said outer tubular body and allowing a rotary movement of said outer tubular body around said inner tubular body in a sliding contact between their respective inner and outer smooth surfaces;

e) a driving member supporting said product and capable of a rotational-translationaly motion within said inner tubular body through a threading engagement with said threaded rod;

f) a removable cover engageable with the upper end of said outer tubular body;

g) perimetrical friction means provided on the outer surface of said driving member and contacting the inner surface of said inner tubular body for providing a fluid-tight seal between said outer surface and said inner surface and preventing said driving member from rotating with respect to the inner tubular body;

h) the improvement wherein said outer body, including the closed bottom and the upwardly projecting central element is moulded as unitary structure of an inelastic plastic material and said connection means consist of a recess axially extending within said threaded rod, said upwardly projecting element being irremovably forced into said recess of said threaded rod to form a single unit therewith and wherein the perimetrical friction means consist of flaring edges and annular flanges projecting from the outer wall of the driving member and exerting elastically a pressure on the inner smooth surface of the inner body.

2. A dispenser as claimed in claim 1 wherein said constraint means consist of a disc-shaped portion projecting from the lower end portion of said threaded rod and an inwardly bent lower end portion of said inner body, said lower end portions of said threaded rod and said inner body having downwardly bent end portions abutting respectively on said lower end portion of said inner body and on the bottom surface of said outer body and a reduced thickness annular sectors adjacent to said downwardly bent end portions for conferring elasticity thereon and allowing a rotation of the inner body with respect to the outer body and vice-versa.

3. A container as claimed in claim 1, wherein a hollow cylindrical projection is formed on the inner surface of the bottom of said outer body, the lower end of said threaded rod being forced between the inner surface of said cylindrical projection and the outer surface of said upwardly projecting central element.

* * * * *